United States Patent [19]

Ferralli

[11] 4,109,752

[45] Aug. 29, 1978

[54] MUFFLER

[75] Inventor: Michael W. Ferralli, Erie, Pa.

[73] Assignee: Lord Corporation, Erie, Pa.

[21] Appl. No.: 698,648

[22] Filed: Jun. 22, 1976

[51] Int. Cl.[2] ..... F01N 1/04; F01N 1/00; F01N 7/16

[52] U.S. Cl. ..... 181/252; 181/250; 181/206; 181/256; 181/282; 181/296

[58] Field of Search ..... 181/42, 48, 33 D, 61, 181/62, 282, 252, 250, 206, 256, 247, 296

[56] References Cited

U.S. PATENT DOCUMENTS

| | | | |
|---|---|---|---|
| 2,046,193 | 6/1936 | Spicer | 181/42 |
| 2,138,510 | 11/1938 | Rauen | 181/59 |
| 2,274,459 | 2/1942 | Rauen | 181/59 |
| 2,337,299 | 12/1943 | Noblitt et al. | 181/54 |
| 2,367,473 | 1/1945 | Smith | 181/48 |
| 2,573,474 | 10/1951 | Marx | 181/47 |
| 2,958,388 | 11/1960 | Paulsen | 181/42 |
| 2,984,315 | 5/1961 | Kleinecke | 181/42 |
| 3,166,382 | 1/1965 | Purse et al. | 181/48 |
| 3,563,339 | 2/1971 | Kellicutt | 181/61 |
| 3,612,215 | 10/1971 | Du Bois | 181/48 |
| 3,692,141 | 9/1972 | Labussiere et al. | 181/33 E |
| 3,955,643 | 5/1976 | Clark | 181/42 |

FOREIGN PATENT DOCUMENTS

| | | | |
|---|---|---|---|
| 716,823 | 10/1931 | France | 181/48 |
| 254,638 | 12/1948 | Switzerland | 181/33 D |
| 733,329 | 7/1955 | United Kingdom | 181/42 |

*Primary Examiner*—Stephen J. Tomsky
*Attorney, Agent, or Firm*—Maurice R. Salada

[57] ABSTRACT

A muffler incorporates a tubular shell that has an acoustically reflective interior circumferential surface. In successive sections taken transversely through the shell, the acoustically reflective surface has at least a portion of its circumference shaped to define at least part of an ellipse or a parabola. Between an inlet into and an outlet from the shell, a fluid flow path extends along an axis lengthwise through the shell. A sound absorptive treatment is disposed along a second axis extending lengthwise through the shell. The treatment is spaced from but communicates with the fluid flow path. At least one of the two axes is defined by corresponding focal points of successive transverse sections taken through the curvilinear portion of the circumference of the acoustically reflective shell surface. In operation, sound emitted from fluid flowing along the fluid flow path is reflected by the reflective shell surface to the sound absorptive treatment. The muffler thus attenuates sound emitting from the fluid without significantly interfering with the flow of fluid.

18 Claims, 7 Drawing Figures

MUFFLER

BACKGROUND OF THE INVENTION

To reduce the noise produced by internal combustion engines, such as those used in automobiles and trucks, it is common to include a silencer or muffler in the exhaust line from the engine. In commercially available, dissipative type mufflers, exhaust gases from an engine are passed through or in close proximity to a mass of sound absorbing material. A commonly used sound absorbing material is fiberglass. The fiberglass may completely fill the shell or casing of the muffler or it may have a gas flow passage formed in it, which will reduce the back pressure caused by the muffler. One muffler design incorporating a sound absorbing material is described and illustrated in Paulsen U.S. Pat. No. 2,958,388.

Many commercially available mufflers for internal combustion engines utilize nondissipative sound attenuating structures and techniques. Rather than incorporating sound absorbing materials or structures, nondissipative or reactive mufflers incorporate and utilize acoustical side branch, wave cancellation and other nondissipative structures and techniques. The most simple design of a commercially available, nondissipative muffler consists of a perforated axial flow duct surrounded by a larger diameter casing or shell. The interior of the casing or shell is typically subdivided by transverse partitions into several compartments of different axial lengths. Sound attentuation is achieved by having the compartments of the shell act as acoustical side branches with respect to sound passing through the perforated flow duct into the compartments. Although such a straight-through, resonator type muffler is economical and produces a low back pressure, it also has a relatively low sound attenuation performance. One design of a straight-through, nondissipative muffler is described and illustrated in Marx U.S. Pat. No. 2,573,474.

Another common commercial design of a nondissipative muffler for an internal combustion engine utilizes a combination of acoustical side branches, wave concellation effects and other sound attenuating structures and techniques to provide a more effective performance than the straight-through type muffler. Such a higher performance muffler typically directs the exhaust gases from the internal combustion engine through a more tortuous flow path than the straight-through muffler before exhausting the gas. One such muffler which should offer better performance than a straight-through type muffler is described and illustrated in Noblitt et al U.S. Pat. No. 2,337,299.

As shown in the drawings for the patents described above, the shells, casings or outer walls for typical muffler designs are oval in transverse section. The oval shape is intended solely to minimize the amount of vertical space that the muffler will occupy beneath the body of a vehicle. By minimizing the vertically oriented dimension of the muffler, a greater clearance can be provided between the muffler and the road surface or, alternatively, the vehicle body may be lowered relative to the road surface. Although space and clearance considerations control the selection of the shape of the shell in typical, commercially available mufflers, it has also been recognized that particular geometric shapes for the shell or outer wall of a muffler may offer improved acoustical performance.

As examples of muffler designs that recognize the potential value of certain geometric shapes for muffler shells or outer walls, Rauen U.S. Pat. Nos. 2,138,510 and 2,274,459 describe and illustrate mufflers that incorporate axial flow conduits for exhaust gas and geometrically shaped side branches defined by the shells of the mufflers. The side branches have parabolic, hyperbolic, elliptical or spherical reflective wall surfaces. The reflective surfaces are oriented so that the geometric shapes are apparent only when taking axial or longitudinal sections through the mufflers. The geometric shapes of the reflective surfaces are selected so that sound energy entering the side branches may be reflected, focused and/or concentrated in one place until the energy is dissipated. At the same time, the exhaust gas introduced into each muffler is permitted to flow freely along the flow conduit and out of the muffler. In some of Rauen's mufflers, sound absorbing material, such as steel wool, mineral wood or asbestos, is used to fill the geometrically shaped, acoustical side branches.

Labussiere et al U.S. Pat. No. 3,692,141 describes and illustrates another muffling structure in which specific geometric shapes are utilized to attenuate noise emitted from a fluid flowing through a duct. In the Labussiere silencer, a baffle or air deflecting body is disposed in the middle of a flow duct from a jet propulsion unit, for example. The leading surfaces of the baffle or deflecting body are parabolically or elliptically shaped. The walls of the flow duct surrounding the body or baffle are lined with sound absorbing acoustical material. Thus, as gas flows through the flow duct and encounters the geometrically shaped surfaces of the baffle or deflecting body, sound travelling axially through the flow duct is reflected from the geometric surfaces into the sound absorbing material lining the walls of the duct. The gas, on the other hand, flows smoothly around the baffle or deflecting body to the exhaust of the duct.

Still another muffler or silencer for a gas flow is described and illustrated in Swiss Pat. No. 254,638. The Swiss silencer incorporates a housing or shell shaped as an ellipsoid of revolution or as a cylinder of elliptical cross section. A fluid inlet pipe opens into the housing at one focal point of its elliptical cross section. At the other focal point of the elliptical cross section is a sphere of material capable of intercepting sound waves reflected toward it. Surrounding the second focal point is a partition or baffle of semielliptical configuration which is parallel to and spaced from the housing. A narrow flow passage is thus defined between the inner surface of the housing and the outer surface of the partition, both of which surfaces are lined with sound absorbing material. The flow passage between the two surfaces leads to an outlet pipe from the housing, which is located, relative to the fluid inlet, behind the sphere of sound intercepting material and behind the partition. The silencer reduces sound levels primarily through the reflection of sound waves from and between the elliptical surfaces which are lined with sound absorbing material. By the time the fluid reaches the outlet from the silencer, the sound has had many contacts with the sound absorbing material within the housing and is significantly reduced in amplitude. At the same time, however, the tortuous flow path provided for the exhaust gas or other fluid tends to create substantial turbulence within the muffler and to increase the back pressure exerted by such a muffler, in comparision to axial flow type mufflers such as are commonly used in automobiles.

SUMMARY OF THE INVENTION

The present invention relates to a compact muffler or silencer for a fluid flow, such as the flow of exhaust gas from an internal combustion engine. The muffler effectively attenuates noise generated within the fluid flow while maintaining a low back pressure in the flow. The structure of the muffler permits a substantially unimpeded axial flow of exhaust gas and includes sound absorbing material to attenuate noise emitted from the fluid flow. A geometrically shaped shell or outer wall for the muffler facilitates the most efficient use of the sound absorbing material.

A muffler according to the present invention has a tubular shell or casing with an acoustically reflective interior circumferential surface. In successive sections taken transversely through the shell, the acoustically reflective surface has at least a portion of its circumference shaped substantially to define at least part of either an ellipse or a parabola. The shell also has a fluid inlet and a fluid outlet. A fluid flow path extends along an axis lengthwise through the shell between the inlet and the outlet. Disposed within the shell along a second axis extending lengthwise through the shell is a sound absorptive treatment. The treatment is spaced from but communicates with the fluid flow path. At least one of the axes along which extend the fluid flow path and the sound absorptive treatment is defined by corresponding focal points of successive transverse sections taken through the curvilinear portion of the circumference of the acoustically reflective shell surface. As a result, fluid, such as exhaust gas from an internal combustion engine, flows axially through the muffler, while sound emitted from the fluid travels to the sound absorptive treatment, either directly or by reflection from the acoustically reflective shell surface.

By providing the shell for the present muffler with a transverse shape resembling a second order curve that has at least one focal point toward which or away from which sound may be reflected, the muffler permits the sound absorptive treatment to be spaced from the fluid flow path and to occupy a minimum of space. As an example, the acoustically reflective shell surface of one embodiment of the invention has a completely elliptical shape in transverse section. The axis along which the fluid flow path lies is defined by one set of corresponding focal points of successive transverse sections taken through the acoustically reflective shell surface. The axis along which the sound absorptive treatment lies is defined by the other focal points of the successive transverse sections. In operation, sound emitted from the fluid flow path will be reflected from the elliptically shaped reflective surface of the shell and will be directed to the sound absorptive treatment, because of the inherent geometric properties of an ellipse. The sound absorptive treatment may thus have a relatively small volume since it need only be located along one of the axes defined by the focal points of the transverse sections taken through the reflective surface.

In another embodiment of the invention, the curvilinear portion of the circumference of the acoustically reflective shell surface is parabolic in section taken transversely through the shell. The axis along which the fluid flow path lies is defined by the focal points of successive transverse sections taken through the curvilinear portion of the circumference of the reflective surface. The sound absorptive treatment extends along an axis on a side of the fluid flow path opposite the vertex of the parabolically shaped portion of the shell surface. The treatment is oriented parallel to the directrix of the parabolically shaped surface and is disposed to intercept sound waves reflected from the parabolic surface. As a result, sound emitted from the fluid flow path is reflected by the parabolically shaped reflective surface to the sound absorptive treatment, which absorbs and attenuates the sound.

The fluid flow path through the muffler of the present invention may be defined by a tubular perforated duct which has a smaller area in transverse section than the shell and which extends lengthwise through the shell from the inlet to the outlet. The interior of the shell may be subdivided into a plurality of sequential compartments by a series of spaced apart transverse partitions. Each partition will have in it an opening that is aligned with openings in other partitions so as to permit fluid flow through the shell. The partitions help to prevent randomly directed sound waves that emanate from the fluid flow path from travelling lengthwise through the shell without striking the sound absorptive treatment. Incorporation of the perforated duct and the transverse partitions will also provide a series of acoustical side branches that may enhance the effectiveness of the muffler.

The present invention incorporates an axial fluid flow path to achieve a low back pressure and utilizes geometrically shaped reflective surfaces to permit efficient use of a compact sound absorptive treatment. The mufflers of the Rauen patents also incorporate axial fluid flow paths and geometrically shaped, acoustically reflective surfaces. Most of the Rauen mufflers, however, do not include a sound absorptive treatment to take advantage of the focusing properties of the reflective surfaces in the mufflers. The Rauen mufflers that do incorporate sound absorbing material inefficiently pack each acoustical side branch with such material. Rauen also utilizes his geometrically shaped reflective surfaces as transverse walls that define a series of separated and distinct acoustical side branches. The reflective surfaces are thus oriented or curved longitudinally of the muffler. The result is an extremely complex design and construction that requires a multiplicity of stamped metal parts. In contrast, the present invention offers the possibility of using a smoothly curved and uniformly shaped outer shell with a relatively small number of optional and identical internal partitions, for example.

BRIEF DESCRIPTION OF THE DRAWINGS

For a better understanding of the invention, reference may be made to the following description of exemplary embodiments of the invention, taken in conjunction with the figures of the accompanying drawings, in which.

DESCRIPTION OF PREFERRED EMBODIMENTS

Figure 1:
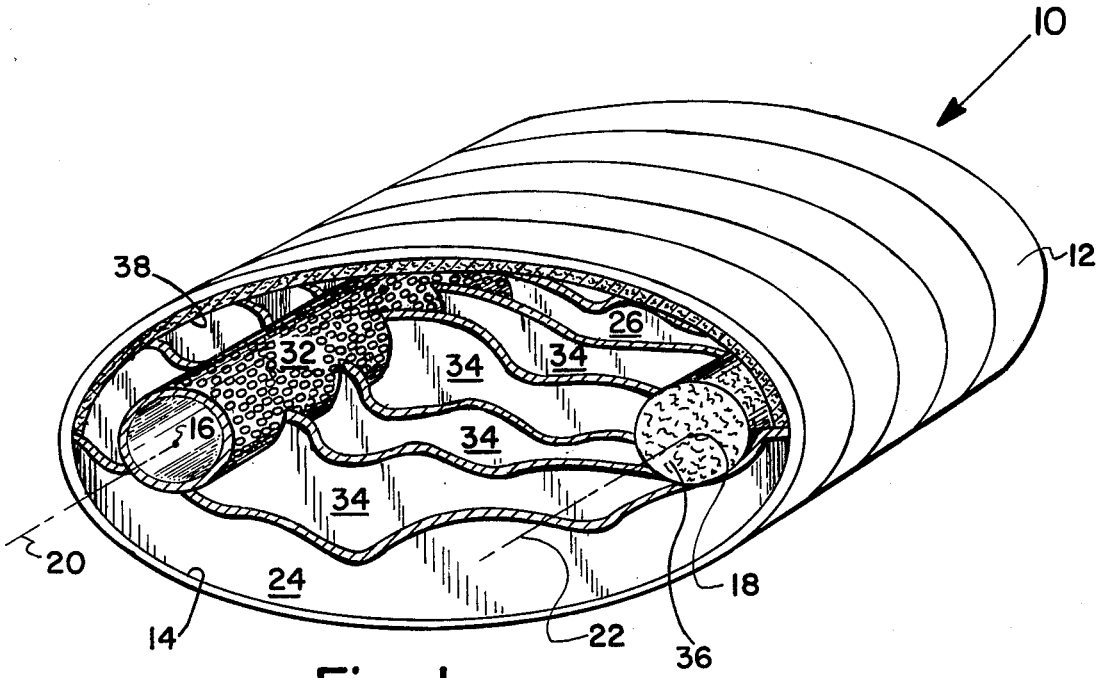
FIG. 1 is an oblique view, partly in section, of one embodiment of a muffler constructed according to the present invention.

FIG. 1 of the drawings illustrates a muffler 10 designed to attenuate the sound emitted from the exhaust of an internal combustion engine, such as the engine for an automobile. The muffler 10 incorporates a tubular shell or housing 12 that has an acoustically reflective interior circumferential surface 14. Suitable materials for fabricating the shell include stainless steel, galvanized steel and other heat and corrosion resistant materials. The shell may vary in length as necessary to fit the space available or achieve a desired degree of sound attenuation. In sections taken transversely through the shell 12, both the shell ad the reflective surface 14 are shaped substantially to define and ellipse. Because of its elliptical shape, the reflective surface 14 has, in each transverse plane through the shell 12, two distinct focal points. Thus, in the endmost plane that extends transversely through the shell 12 in FIG. 1, the circumference of the shell and of the reflective surface 14 has two focal points 16 and 18. Successive transverse sections taken through the shell 12 similarly define a pair of focal points. Corresponding focal points of successive transverse sections through the shell 12 define a pair of axes 20 and 22 extending lengthwise through the shell.

Figure 2:
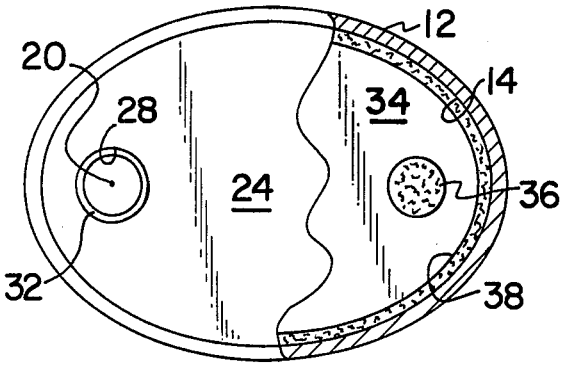
FIG. 2 is an end view, partly in section, of one end of the muffler of FIG. 1.
Figure 3:
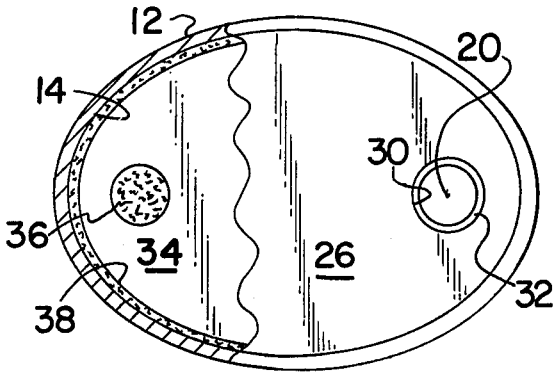
FIG. 3 is an end view, partly in section, of the other end of the muffler of FIG. 1.

In the muffler 10, the shell 12 is closed at each of its ends by an elliptically shaped end wall 24 or 26, as shown in FIGS. 2 and 3, respectively. The end walls 24 and 26 are preferably formed of the same material as the shell 12 and are secured to the shell, as by welding, for example. An opening 28 is formed in the end wall 24 to define an inlet into the shell 12 for fluid such as the exhaust gas from an internal combustion engine. An outlet from the shell 12 for the fluid is defined by an opening 30 formed in the opposite end wall 26. The inlet and outlet openings 28 and 30 are located at corresponding focal points of their respective elliptically shaped end walls 24 and 26. As a result, both the inlet opening 28 and the outlet opening 30 lie on the axis 20 extending through the shell 12.

The fluid flow path through the muffler 10 between the inlet opening 28 and the outlet opening 30 is defined by a tubular perforated duct 32. The duct 32 is of smaller area in transverse section than the shell 12 and extends lengthwise through the shell. Materials that are suitable for fabricating the shell 12 will also be suitable for fabricating duct 32. Preferably, the duct 32 will be sufficiently rigid to be supported solely by contact with or attachment to the end walls 24 and 26 at the inlet and outlet openings 28 and 30. Alternatively, or in addition, the duct 32 may be supported by hangers (not shown) secured to the shell 12 or by transverse partitions 34, such as are described below.

The interior of the shell 12 is subdivided into a plurality of sequential compartments by a series of spaced apart partitions 34 oriented transversely of the shell. The partitions are impermeable and acoustically reflective and may be fabricated of the same materials as the shell 12. They are secured, such as by welding, to the interior surface 14 of the shell 12. Each partition 34 is elliptical in shape and has in it an opening that is aligned with and receives the perforated duct 32. The duct receiving opening is located at one focal point of the circumference of each elliptical partition 34. At the other focal point of the circumference of each partition 34 is a second opening that receives and supports an elongated cylindrical sound absorptive treatment 36, such as a body of fibrous sound absorbing material. The body of sound absorbing material 36 and the openings in the partitions 34 which receive the body are all aligned with and lie along the axis 22 through the shell 12.

The sound absorptive treatment utilized in the muffler 10 may be formed of any sound absorbing material that can withstand the high temperatures generated within the muffler. Steel wool, mineral wool and asbestos are examples of some materials that may be suitable. The sound absorbing material may also consist of porous or cellular ceramic materials similar to the materials used as carriers for catalyst in catalytic converters for internal combustion engines. Such ceramic materials may have sufficient porosity to absorb sound energy and also have the high temperature resistance that is required for use in a muffler for an internal combustion engine. Another sound absorptive treatment that might be used in the muffler 10 is a treatment manufactured from metal honeycomb material, such as is described and illustrated in Wirt et al U.S. Pat. No. 3,913,702.

In operation, the muffler 10 of FIG. 1 of the application drawings is connected to a source of pulsating, flowing fluid, such as the exhaust manifold from an internal combustion engine. The pulsating fluid is introduced into the shell 12 through the inlet opening 28 and flows lengthwise through the perforated duct 32 to the outlet opening 30. As the fluid travels along the duct 32, sound is radiated from the fluid through the perforations in the wall of the duct 32. Because of the circular shape of the duct 32 and its disposition along the axis 20, sound emerging from the duct appears to emanate from a focal point of the elliptical circumference of the shell 12 and its acoustically reflective internal circumferential surface 14. Due to the geometry of the reflective surface 14, sound radiated from the duct 32 perpendicular or at a substantial angle to the axis 20 must either travel directly to the body of sound absorbing material 36 or be reflected from the surface 14 to the sound absorbing material. As sound waves enter the absorbing material 36, the kinetic energy of the air molecules making up the waves is dissipated in heat. Thus, the total energy in each sound wave is reduced and less energy is available to be transferred to the surroundings as sound. Since most sound that originates at the focal axis 20 of the elliptically shaped shell must, theoretically at least, pass through the focal axis 22 of the shell, a relatively small volume of sound absorbing material 36 may be placed along the axis 22 and still absorb a significant amount of the sound emanating from the duct 32.

In the muffler 10, the transverse partitions 34 prevent sound that radiates from the duct 32 at only a small angle to the axis 20 from travelling along the length of the muffler, instead of toward the sound absorbing material 36. The partitions 34 also afford a series of acoustical side branches within the shell 12, as represented by the sequential compartments into which the interior of the shell is divided. To provide effective sound attenuation through utilization of the sound absorbing material 36 and the reflective shell surface 14, adjacent partitions 34 should be spaced from each other a distance not more than about $\frac{1}{4}$ to about $\frac{1}{2}$ of a wave length of the highest sound frequency to be attenuated by the muffler 10. On the other hand, by successively increasing the spacing between the partitions, the attenuating effect of the acoustical side branches defined by the partitions can be experienced over a broad range of acoustical frequencies. To enhance the sound attenuating characteristics of the muffler 10, the acoustically reflective interior circumferential surface 14 of the shell 12 may be lined with a layer of a sound absorbing material 38.

Although the embodiment of the invention illustrated in FIG. 1 of the application drawings incorporates a fluid inlet 28 and a fluid outlet 30 formed in the end walls 24 and 26 of the muffler 10, the fluid flow may also be introduced through the side of the shell 12. If such a side introduction of fluid is utilized, however, the inlet and outlet should consist of tubes with 90° bends in them, such as are shown in Swiss Pat. No. 254,638. The angled or bent tubes will insure that an axial flow path is defined for fluid flowing through the muffler 10.

Figure 4:
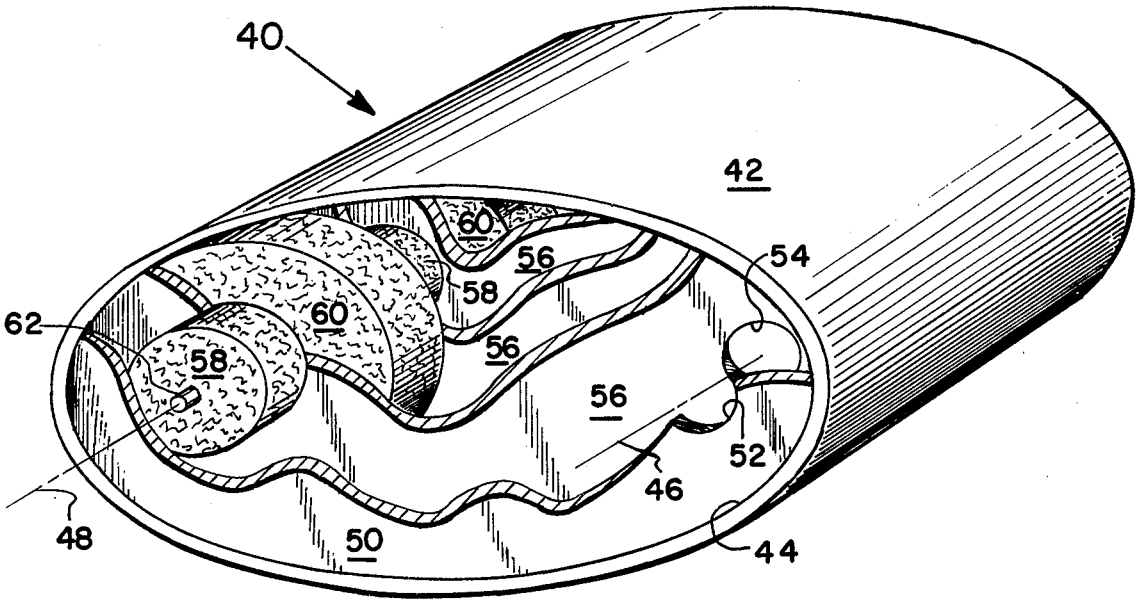
FIG. 4 is an oblique view, partly in section, of a second embodiment of a muffler constructed according to the present invention.

A second embodiment of a muffler constructed according to the present invention is illustrated in FIG. 4 of the application drawings. The muffler 40 of FIG. 4, like the muffler 10 of FIGS. 1–3, includes a tubular shell or housing 42 that has an acoustically reflective interior circumferential surface 44. The shell 42 is fabricated of heat and corrosion resistant material. Both the shell 42 and the reflective surface 44 are shaped substantially to define an ellipse. Thus, in each section taken transversely through the shell 42, the circumference of the shell has two focal points. Corresponding focal points of successive transverse sections taken through the shell 42 define two axes 46 and 48 that extend lengthwise through the shell.

As in the muffler 10, the elliptically shaped, tubular shell 42 is closed at each end by an elliptical end wall, only one of which 50 is shown. An inlet opening 52 and an outlet opening (not shown) are formed in different end walls at corresponding focal points of the elliptically shaped walls. Consequently, a fluid flow path between the inlet 52 and the outlet extends lengthwise through the shell along the axis 46. Unlike the muffler 10, however, the muffler 40 does not include a perforated duct extending lengthwise through the shell 42 to define the fluid flow path through the shell. Instead, the fluid flow path through the shell 42 is defined by the inlet and the outlet openings and by aligned openings 54 formed at the focal points of elliptically shaped transverse partitions 56. The partitions 56, like the partitions 34 of FIG. 1, are impermeable and subdivide the interior of the shell 42 into a plurality of sequential compartments.

Lying along the second axis 48 defined by the focal points of successive transverse sections through the shell 42 is a series of bodies 58 and 60 of sound absorbing material. The bodies 58 and 60 are disc-shaped with the bodies 58 being roughly half the diameter of the bodies 60. The dimensions of the bodies may be varied, in accordance with the discussion that follows, depending upon the primary sound frequencies to be absorbed. The number of different body sizes may also be varied. One body 58 or 60 is located in each of the successive compartments defined by the partitions 56. The bodies 58 and 60 are coaxial and alternate throughout the length of the shell 42. They are all mounted on a rigid support rod 62 that extends lengthwise through the shell and is supported at its ends in the end walls of the shell.

In operation, the muffler 40 functions in a manner similar to the muffler 10. A flow of pulsating fluid, such as the exhaust gas from an internal combustion engine, is introduced into the shell 42 through the inlet 52 and flows along the fluid flow path defined by the partition openings 54 to the outlet opening (not shown). Sound emanating from the fluid flow path generally perpendicular to the axis 46 is reflected from the acoustically reflective shell surface 44 to the bodies of sound absorbing material 58 and 60 or travels directly to the bodies of sound absorbing material. As can be seen in FIG. 4, the optional layer of sound absorbing material that may be applied to the acoustically reflective surface 44 is not incorporated in the muffler 40.

The use of two different sizes of sound absorbing bodies 58 and 60 in the muffler 40 tends to improve the frequency range and effectiveness of the muffler 40 with respect to the muffler 10. The primary sound frequency that is absorbed by the bodies 58 and 60, and the body 36 in the muffler 10, is affected by the volume and, more particularly, the thickness of sound absorbing material available to intercept sound waves. The thickness of each of the bodies 36, 58 and 60 with respect to sound emanating from the fluid flow paths of the mufflers 10 and 40, respectively, is a dimension measured radially of each body. Thus, with an identical radial thickness of sound absorbing material in each of its sequential compartments, the muffler 10 tends to have a single frequency at which it functions most effectively. In contrast, since the compartments in the muffler 40 contain two different radial thicknesses of sound absorbing material, the muffler 40 tends to have two frequencies of optimum performance, which increases the overall effectiveness of the muffler 40 with respect to the muffler 10. The frequencies of optimum performance of the muffler 40 will be the frequencies that correspond to sound wavelengths of four times the radii of the bodies 58 and 60.

Figure 5:
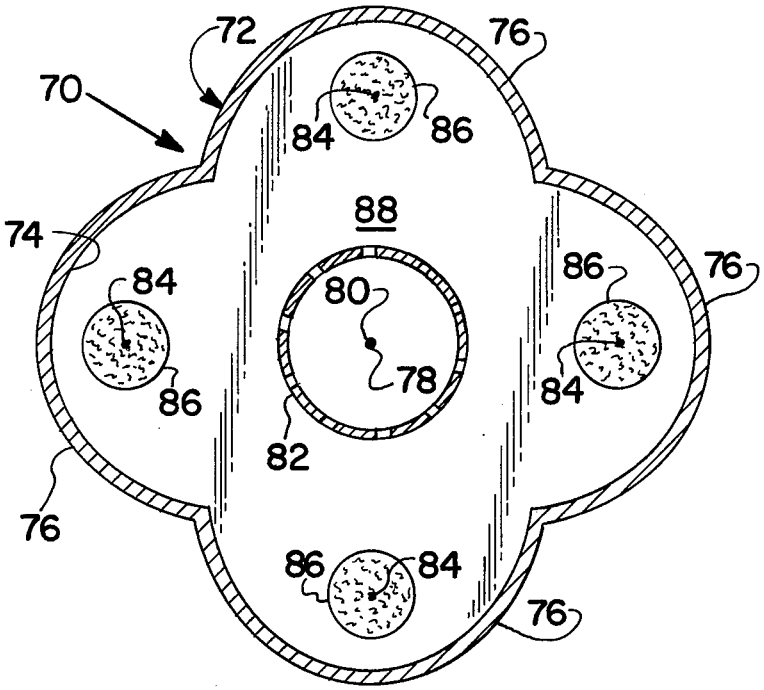
FIG. 5 is a view in transverse section through an embodiment of a muffler constructed according to the present invention.

FIG. 5 of the application drawings illustrates, in transverse section, yet another muffler that incorporates elliptically shaped, acoustically reflective surfaces. The muffler 70 of FIG. 5 has a tubular shell 72 with an acoustically reflective interior circumferential surface 74. Unlike the mufflers 10 and 40 of FIGS. 1–3 and 4, however, the shell 72 of the muffler 70 is not a complete ellipse in transverse section. Instead, the shell 72, and the reflective surface 74, has four identical lobes 76 which are symmetrically arranged. Each lobe 76 defines, in transverse section, approximately half of an ellipse. The lobes may, however, define any portion of an ellipse, may each define a different portion of an ellipse, and may be asymmetrically arranged. The number of lobes may be varied.

In section taken transversely through the shell 72, each elliptically shaped lobe 76 has one focal point 78 that is coincident with the central longitudinal axis 80 of the shell 72. A tubular duct 82 extends lengthwise through the shell 72 coaxially with the axis 80 to define a fluid flow path through the shell 72. If the focal points 78 of the elliptically shaped lobes 76 were not coincident with the central axis 80, the perforated duct 82 would be of sufficiently large diameter to encompass the focal points 78. The other focal point 84 of each elliptically shaped lobe 76 is disposed radially outwardly of the first focal point 78 of the lobe. At least one body of sound absorbing material 86 is disposed within each lobe 76 along an axis defined by the second focal points 84 of successive transverse sections taken through the lobe. As in the other embodiments of the invention, the interior of the shell 72 is subdivided into a series of sequential compartments by a plurality of four-lobed transverse partitions 88.

The muffler 70 of FIG. 5 functions in much the same manner as the mufflers 10 and 40 of FIGS. 1–3 and 4. Sound emitted from the perforated duct 82 at an angle generally perpendicular to the axis 80 travels either directly to one of the bodies of sound absorbing material 86 or to a portion of the acoustically reflective shell surface 74 from which the sound is then reflected to one of the sound absorbing bodies 86. As in the embodiment of FIG. 1, the acoustically reflective shell surface 74 may be lined with a layer of sound absorbing material. In alternate construction of the muffler 70, the bodies of sound absorbing material 86 might be replaced with perforated flow ducts and the perforated duct 82 might be replaced with one or more bodies of sound absorbing material so as to reverse the operation of the muffler.

Figure 6:
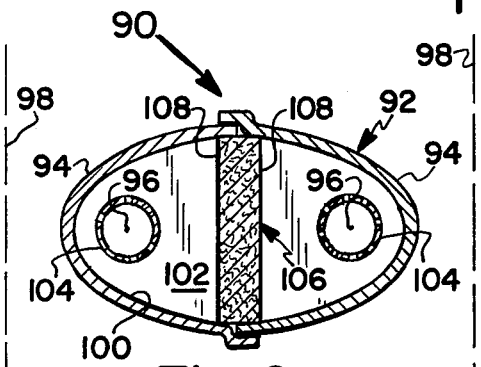
FIG. 6 is a sectional view of another muffler constructed according to the present invention.

FIG. 6 of the application drawings illustrates an embodiment of the present invention in which the two sides of the shell 92 of the muffler 90 are identical shell halves 94, shaped parabolically in transverse section. Each shell half 94 has, in transverse section, a focal point 96, which is located within the shell 92, and a directrix 98. The halves 94 are secured together, as by welding, at their juncture. As in the previously discussed embodiments of the invention, the shell 92 of the muffler 90 has an acoustically reflective internal circumferential surface 100. The interior of the shell 92 is subdivided into a series of sequential compartments by a plurality of transversely extending partitions 102.

Within each shell half 94, a perforated duct 104 extends lengthwise through the shell 92 along an axis defined by the focal points 96 of successive transverse sections taken through the shell. Each perforated duct 104 extends between an inlet (not shown) and an outlet (not shown) for each shell half 94 formed in opposite end walls (not shown) of the shell 92. The ducts 104 are supported by the end walls (not shown) and the partitions 102. Disposed between the two ducts 104 and extending lengthwise through the shell 92 is a sheet of sound absorbing material 106. The sound absorbing material 106 extends entirely across the shell 92 and from one end wall to the other end wall of the shell so as to completely divide the interior of the shell 92 into two halves. Each side surface 108 of the sound absorbing material 106 is oriented to be parallel to a directrix 98 of one parabolically shaped shell half 94. The sound absorbing material 106 may be a single body that extends through each partition 102, as described above, or it may consist of a plurality of separate bodies, one located in each successive compartment defined by the partitions 102.

In operation of the muffler 90, sound is emitted from fluid flowing along the perforated ducts 104. Since each half 94 of the shell 92 is parabolically shaped, and since each perforated duct 104 is located at a focus 96 of a parabolically shaped shelf half, sound emitted from the ducts 104 either travels directly to the sound absorbing material 106 or is reflected from the acoustically reflective interior surface 100 of the shell 92 to the sound absorbing material 106. As in the embodiment of the invention shown in FIGS. 1–3 of the application drawings, a layer of sound absorbing material may be applied to the surface 100 to enhance the sound absorbing characteristics of the muffler 90.

Although the two halves 94 of the shell 92 of the muffler 90 are parabolically shaped in the illustrated embodiment, the muffler 90 would also function effectively if the shell 92 were elliptically shaped. With two semielliptically shaped shell halves 94, sound emanating from either flow duct 104 would travel directly or be reflected toward the other duct and would necessarily enter the sound absorbing material 106.

Figure 7:
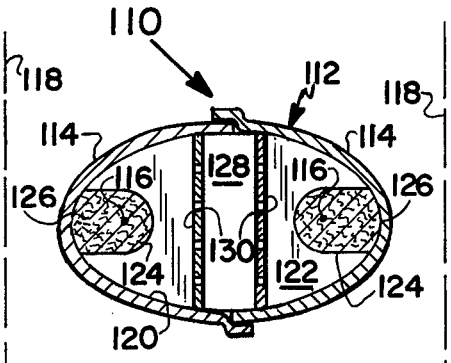
FIG. 7 is a sectional view of still another muffler constructed according to the present invention.

FIG. 7 of the application drawings illustrates an embodiment of the invention which may be considered to be the reverse of the construction shown in FIG. 6. The muffler 110 of FIG. 7 has a shell 112, of which the two axially extending halves 114 are each parabolically shaped in transverse section. Each shell half 114, in section taken transversely through the shell 112, has a focus 116 located within the shell 112 and a directrix 118. The halves 114 are secured together at their juncture. The interior of the shell 112 has an acoustically reflective circumferential surface 120 and is subdivided into a plurality of sequential compartments by a series of transverse partitions 122.

Within each half 114 of the shell 112 is at least one body of sound absorbing material 124 that lies along an axis defined by the focal points of successive transverse sections through the shell half. Each body of sound absorbing material 124 extends from the immediate area of the focus 116 of its respective shell half 114 to the vertex 126 of the shell half. Disposed between the two foci 116 of the shell halves 114 is a perforated duct 128. The duct 128 extends throughout the length of the shell 112 and has parallel perforated sides 130. The sides 130 of the duct 128 extend entirely across the shell 112 so as to divide the interior of the shell 112 into two halves extending axially through the shell.

In operation of the muffler 110, a flow of pulsating fluid, such as the exhaust gas from an internal combustion engine, is introduced into the duct 128 through an end wall (not shown) of the muffler. Sound that radiates from the perforations in the sides 130 of the duct 128 at a generally perpendicular angle to the sides travels either directly to the bodies of sound absorbing material 124 or is reflected from the interior circumferential surface 120 of the shell 112. As can be seen in FIG. 7, the sides 130 of the duct 128 are oriented to be parallel to the adjacent directrixes 118 of the parabolically shaped shell halves 114. Such an orientation of the duct sides 130 enhances the tendency of sound to travel toward the acoustically reflective shell surface 120 in a manner such that the sound will be reflected directly to the foci 116 of the shell halves 114. As a practical matter, however, only a small proportion of the sound radiating from the perforated sides 130 of the duct 128 will travel in the perpendicular rays required to insure reflection to the foci 116. Consequently, the bodies of sound absorbing material 124 are extended from the foci 116 of the duct halves 114 to their respective vertices 126. The extended bodies of sound absorbing material 124 tend to intercept sound waves that would otherwise pass behind the foci 116 relative to the duct 128.

Although it is not shown on the application drawings, the embodiment of FIG. 5 of the application drawings could be constructed so that each lobe 76 is parabolically, rather than semi-elliptically, shaped. In such a muffler, flow ducts would be located along the foci of respective lobes 76, and a mass of sound absorbing material would be located along the central axis 80 of the shell. It would also be possible to utilize only half of each of the mufflers shown in FIGS. 6 and 7. With such a construction, each muffler 90 and 110 would consist of only a single parabolically or semi-elliptically shaped shell half 94 or 114. A vertically oriented shell wall would be disposed adjacent to the body of sound absorbing material 106 or the duct 128, opposite the focus 96 or 116. Any of the shells 12, 42, 72, 92 or 112 could be tapered uniformly along its length, if that were desirable. It would also be possible to sectionalize the shells so that a complete muffler would consist of a series of shell sections joined end-to-end. Such an arrangement would permit each individual shell section to be designed to operate most effectively at a selected sound frequency so that the performance of the complete muffler could be "tailored" by appropriate selection of shell sections. In all of the embodiments of the invention, however, the fluid flow path or paths and the body or bodies of sound absorbing material remain spaced from, but in communication with each other.

It will be understood that the embodiments described above are merely exemplary and that persons skilled in the art may make many variations and modifications without departing from the spirit and scope of the invention. In particular, although the foregoing discussion has dealt primarily with embodiments of the invention intended for use with internal combustion engines, the invention may be used to attenuate the noise emanating from any duct or fluid flow passage. All such modifications and variations are intended to be within the scope of the invention as defined in the appended claims.

What is claimed is:

1. A muffler comprising:

(a) a tubular shell having an interior circumferential surface which is acoustically reflective and which is successive sections taken transversely through the shell has at least a portion of its circumference shaped substantially to define at least part of an ellipse;

(b) means defining a fluid inlet into the shell;

(c) means defining a fluid outlet from the shell;

(d) means defining a fluid flow path that extends lengthwise through the shell between the inlet and the outlet along a first axis; and (e) a sound absorptive treatment disposed within the shell along a second axis extending lengthwise through the shell, the fluid flow path being defined such that communication is afforded between the flow path and the sound absorptive treatment, the treatment being spaced from the fluid flow path and spaced from at least a portion of the interior circumferential surface of the shell, the treatment also occupying within the shell a volume that is less than the total volume enclosed by the shell minus total volumes occupied within the shell by the fluid flow path and the means defining the fluid flow path, at least one of said first and second axes being defined by corresponding focal points of successive transverse sections taken through said portions of the circumference of the acoustically reflective shell surface, said axes being disposed relative to each other such that at least a portion of any sound emitted from fluid flowing along the flow path is reflected by said reflective shell surface to said sound absorptive treatment.

2. A muffler, according to claim 1, wherein the first axis is defined by corresponding first focal points of successive transverse sections taken through said portion of the circumference of the acoustically reflective shell surface, and the second axis is defined by corresponding second focal points of successive transverse sections taken through said portion of the circumference of the acoustically reflective shell surface.

3. A muffler, according to claim 1, wherein the first axis is defined by corresponding first focal points of successive transverse sections taken through said portion of the circumference of the acoustically reflective shell surface, and wherein the second axis and the second absorptive treatment extend lengthwise through the shell intermediate and spaced from both the first and the second focal point of each of said successive transverse sections.

4. A muffler, according to claim 1, wherein said inlet and outlet defining means include an end wall at each end of the shell, the inlet to the shell being formed in one end wall and the outlet from the shell being formed in the other end wall.

5. A muffler, according to claim 1, wherein said fluid flow path defining means includes a tubular perforated duct of smaller area in transverse section than the shell, said duct extending lengthwise through the shell from the inlet to the outlet to define said fluid flow path and being spaced from the sound absorptive treatment that is disposed along the second axis.

6. A muffler, according to claim 1, wherein said fluid flow path defining means includes a plurality of spaced-apart transverse partitions disposed within the shell and subdividing the shell into a plurality of sequential compartments, each partition having in it an opening that is aligned with said first axis so as at least partially to define said fluid flow path through the shell.

7. A muffler, according to claim 6, wherein the sound absorptive treatment includes a plurality of bodies of sound absorbing material disposed within the shell along said second axis, at least one body of sound absorbing material being located in each of the sequential compartments.

8. A muffler, according to claim 6, wherein adjacent partitions are spaced from each other a distance not more than about one-quarter to one-half of a wave length of the highest sound frequency to be attenuated by the muffler 9. A muffler, according to claim 1, also comprising a layer of a sound absorptive treatment secured to said interior circumferential surface of the shell and spaced at least a part from the sound absorptive treatment disposed along the second axis.

10. A muffler, according to claim 1, wherein the interior circumferential surface of the shell defines in section taken transversely through the shell a substantially elliptical closed curve.

11. A muffler, according to claim 1, wherein the acoustically reflective interior surface of the shell has in section taken transversely through the shell at least two lobes which are each shaped to define at least part of a substantially elliptical curve and which extend radially outwardly relative to a central longitudinal axis of the shell, each transverse section through an elliptically shaped lobe having (i) one focal point disposed at least adjacent to said central longitudinal axis and (ii) a second focal point disposed radially outwardly of said first focal point relative to said central longitudinal axis, a sound absorptive treatment being disposed within each lobe along an axis defined by the second focal points of successive transverse sections taken through said lobe, said central longitudinal axis being coincident with the first axis and the fluid flow path, and each sound absorptive treatment being spaced from and in communication with the fluid flow path.

12. A muffler comprising:

(a) a tubular shell of substantially elliptical transverse section having an acoustically reflective interior circumferential surface;

(b) an elliptical end wall at each end of the shell, a fluid inlet being formed in one end wall and a fluid outlet in the other end wall, the inlet and outlet being located at corresponding points in their respective end walls such that a fluid flow path from the inlet to the outlet extends lengthwise through the shell along a first axis defined by corresponding first focal points of successive elliptical transverse sections taken through the shell;

(c) a plurality of spaced apart, elliptical partitions disposed within the shell and subdividing the shell into a plurality of sequential compartments, each partition having in it an opening that is aligned with said first axis so as at least partially to define said fluid flow path through the shell; and (d) at least one body of sound absorbing material spaced from the fluid flow path and from at least a portion of the reflective interior circumferential surface of the shell and being disposed within the shell along a second axis defined by second focal points of said successive elliptical transverse sections taken through the shell, the fluid flow path through the shell being defined such that communication is afforded between the flow path and the second absorbing material, the sound absorbing material absorbing sound which emanates from the fluid flow path and is reflected toward the material by the reflective elliptical surface of the shell.

13. A muffler, according to claim 12, also comprising a tubular perforated duct of smaller area in transverse section than the shell, said duct extending lengthwise through the shell from the inlet to the outlet along said first axis and through the openings in said partitions, said at least one body of sound absorbing material being spaced from the duct.

14. A muffler, according to claim 12, wherein the body of sound absorbing material extends throughout the length of the shell and wherein each transverse partition has in it two openings, one of said partition openings being aligned with the first axis and the second of said partition openings being aligned with the second axis to receive said body of sound absorbing material.

15. A muffler comprising:

(a) a tubular shell having an acoustically reflective interior circumferential surface and in transverse section having at least two lobes which are each spaced to define at least part of a substantially elliptical curve and which extend radially away from a central longitudinal axis of the shell, each elliptically shaped lobe having a first focal point disposed at least adjacent said central longitudinal axis and a second focal point disposed radially outwardly of said first focal point relative to said central longitudinal axis;

(b) an end wall at each end of the shell, a fluid inlet being formed in one end wall and a fluid outlet in the other end wall, the inlet and outlet being located at corresponding points in their respective end walls such that a fluid flow path from the inlet to the outlet extends lengthwise through the shell along the central lonngitudinal axis of the shell and encompasses the first focal points of successive transverse sections taken through each lobe;

(c) a plurality of spaced apart transverse partitions disposed within the shell and subdividing the shell into a plurality of sequential compartments, each partition having in it an opening that is aligned with the central longitudinal axis of the shell so as at least partially to define said fluid flow path through the shell; and (d) a least one body of sound absorbing material spaced from the fluid flow path and from at least a portion of the reflective interior circumferential surface of the shell and disposed within each lobe of the shell along an axis defined by the second focal points of successive transverse sections taken through said lobe of the shell, said at least one body of sound absorbing material occupying within the shell a total volume that is less than the total volume enclosed by the shell minus total volumes occupied within the shell by the fluid flow path and by any structure, including the transverse partitions, that at least partially defines the fluid flow path, the fluid flow path through the shell being defined such that communication is afforded between the flow path and the sound absorbing material, the sound absorbing material absorbing sound which emanates from the fluid flow path and is reflected toward the material by the reflective elliptical surface of the shell.

16. A muffler, according to claim 15, wherein the shell has four lobes, adjacent lobes being oriented generally perpendicular to each other.

17. A muffler, according to claim 16, wherein the first focal point of each lobe is coincident with the central longitudinal axis of the shell.

18. A muffler, according to claim 15, also comprising a tubular perforated duct of smaller area in transverse section than the shell, said duct extending lengthwise through the shell from the inlet to the outlet along said central axis and through the openings in the partitions, said at least one body of sound absorbing material in each lobe being spaced from the duct.

* * * * *